United States Patent [19]

Shaffer et al.

[11] 4,245,875

[45] Jan. 20, 1981

[54] HEAVY DUTY PLUG AND SOCKET

[75] Inventors: Howard R. Shaffer, Millersburg; Thomas H. Wycheck, Harrisburg, both of Pa.

[73] Assignee: AMP Incorporated, Harrisburg, Pa.

[21] Appl. No.: 49,251

[22] Filed: Jun. 18, 1979

[51] Int. Cl.³ ..... H01R 13/642

[52] U.S. Cl. ..... 339/32 R; 339/39; 339/44 M; 339/184 M

[58] Field of Search ..... 339/44, 184, 186, 32, 339/39

[56] References Cited

U.S. PATENT DOCUMENTS

| | | | |
|---|---|---|---|
| 3,008,116 | 11/1961 | Blanchenot | 339/186 M |
| 3,614,711 | 10/1971 | Anderson | 339/186 M |
| 3,874,761 | 4/1975 | Stauffer | 339/184 R |
| 3,915,476 | 10/1975 | Burkle | 339/10 |
| 4,109,989 | 8/1978 | Snyder, Jr. et al. | 339/94 M |
| 4,113,333 | 9/1978 | Horowitz | 339/14 P |

FOREIGN PATENT DOCUMENTS

| | | | |
|---|---|---|---|
| 2243825 | 3/1974 | Fed. Rep. of Germany | 339/186 M |

*Primary Examiner*—John McQuade

*Attorney, Agent, or Firm*—Russell J. Egan

[57] ABSTRACT

A heavy duty connector is disclosed having a plug member and a receptacle member each including a first set of standard terminals and a second set of auxiliary terminals. The subject receptacle will accept a standard plug in a partially mated condition, engaging the first terminals without damaging the second terminals. The subject plug member will fully mate with the subject receptacle, engaging both sets of terminals, and fully mate with a standard receptacle, the second terminals not being engaged. Thus, any combination of the subject and standard connector members are intermatable. The cover of the subject receptacle member is profiled to hold a standard plug in the partially mated condition and the subject plug in a fully mated condition.

5 Claims, 6 Drawing Figures

HEAVY DUTY PLUG AND SOCKET

BACKGROUND OF THE INVENTION

1. The Field Of The Invention

The present invention relates to a heavy duty connector and in particular to a connector having a receptacle member which will accept both a standard and the subject plug in partially and fully mated conditions, respectively, and a plug member matable in both the subject and standard receptacles.

2. The Prior Art

The evolution of technology of trailed vehicles has arrived at the state where the trailed vehicle is performing a wider variety of functions than ever before. It is no longer adequate for the trailer portion to simply carry a load and perhaps be provided with running lights. The newer trailed vehicles have many pieces of sophisticated electrical and electronic equipment for providing a wide variety of functions far greater than mere lighting. For example, in commercial vehicles it may be desired to have electric braking that will sequentially break as well as provide anti-skid control for the braking. In the agriculture area the trailed vehicle may be providing a seed dispensing and counting function or a crop selection and measurement function. All of these functions must be controlled from the tractor or towing vehicles with proper operation of the function being displayed for the driver.

There are a wide variety of known heavy duty connectors such as those noted by U.S. Pat. No. 4,109,989.

SUMMARY OF THE INVENTION

The present invention concerns an improved heavy duty electrical connector system which has a receptacle member and a plug member, each having arrays of primary and secondary terminals. The receptacle member receives the subject plug member in a fully mated condition and a standard plug member in a partially mated condition which is adequate to establish electrical interconnection with the primary terminals carried thereby and without interfering with or causing damage to the secondary terminals of the subject receptacle member which can not be accommodated by the standard plug. The receptacle member has a housing formed with a cylindrical portion extending from and surrounding a mating face. A first array of primary electrical terminals extend from the mating face a first distance and a second array of different secondary terminals extend from the face a second distance less than that of the primary terminals. The cylinder is profiled to provide polarized mating with the plugs and has at least one integral limiting abutment spaced from the mating face a distance greater than the distance of the secondary terminals but less than the distance of the primary terminals. The receptacle member is further provided with a spring loaded cover which encloses the open end thereof and which cover has first and second means for holding the subject or a standard plug member, respectively, in the receptacle member. The subject plug member is provided with first and second arrays of mating primary and secondary terminals each aligned to mate with a respective primary and secondary terminal of the receptacle member. The plug member is further provided with at least one recess adapted to accommodate therein the limiting abutment of the receptacle member allowing full mating of the plug member in the receptacle member.

It is therefore an object of the present invention to produce an improved heavy duty electrical connector which will accommodate both the subject mating plug member in a fully mated condition and also a standard plug in a partially mated condition without the standard plug adversely affecting terminals of the receptacle member.

It is another object of the present invention to produce a heavy duty electrical connector having first and second arrays of primary and secondary terminals, respectively, arranged therein with abutment means providing protection of the second array of secondary terminals from damage which could result from attempted intermating of a standard plug, which cannot accommodate the second terminals, in the subject receptacle member.

It is a further object of the present invention to produce a heavy duty electrical connector having a receptacle which can accommodate the subject plug member in a full mating condition or a standard plug in a partially mated condition whereby first and second arrays of primary and secondary terminals, respectively, carried by the receptacle member are mated with like terminals of the mating plug member with the standard plug neither engaging nor damaging the secondary terminals.

It is a further object of the present invention to produce a heavy duty electrical connector which can be readily and economically manufactured.

The means for accomplishing the foregoing objects and other advantages of the present invention will become apparent to those skilled in the art from the following detailed description taken with reference to the accompanying drawings.

DETAILED DESCRIPTION OF THE PREFERRED EMBODIMENT

Figures 1, 2, 3:
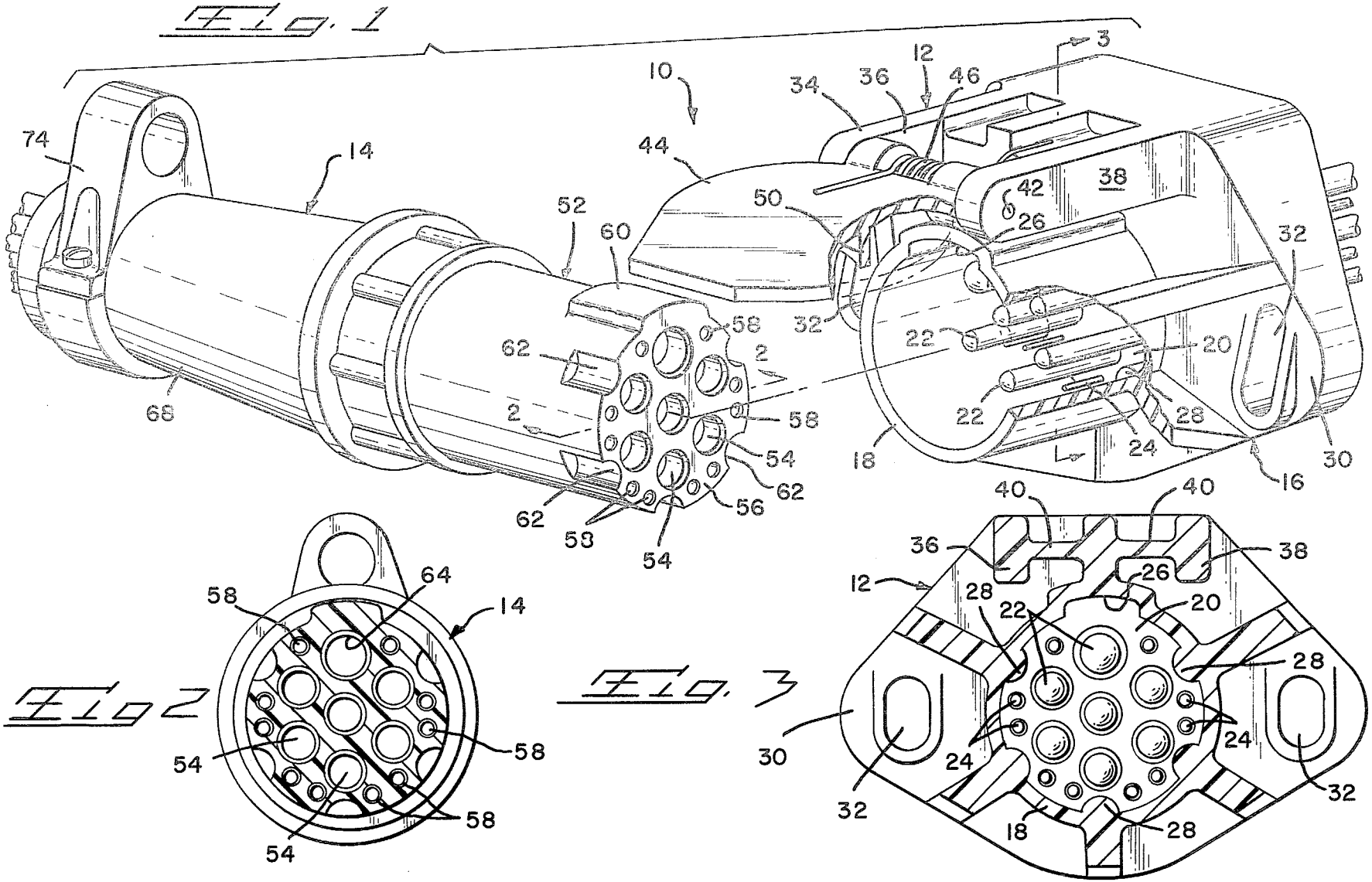
FIG. 1 is an exploded perspective view, partially in section, of the heavy duty electrical connector according to the present invention.
FIG. 2 is a transverse section through the plug member of the present invention taken along line 2—2 of FIG. 1.
FIG. 3 is a transverse section through the receptacle member of the present invention taken along line 3—3 of FIG. 1.

The subject connector assembly 10 includes a receptacle member 12 and a plug member 14.

The receptacle member 12 is shown in an embodiment adapted to be mounted on a bulkhead or the like (not shown) and could be provided with a seal (also not shown) between the receptacle and bulkhead if such sealing was necessary. The receptacle member 12 includes a receptacle housing 16 having a centrally disposed substantially cylindrical portion 18 extending from and surrounding a mating face 20. A plurality of primary terminal pins 22 extend a first distance from the mating face 20 in a first array and a second plurality of secondary terminal pins 24 likewise extend a second distance from the mating face 20 in a second array. The cylindrical portion 18 is provided with a keyway 26 extending longitudinally the entire length thereof and a plurality of abutments 28 inwardly directed about the periphery of the cylindrical portion at the mating face 20. The abutments 28 have a length greater than the secondary terminal pins 24 and less than the first terminal pins 22. The housing 16 includes a peripheral flange 30 having bores 32 therein adapted to receive mounting means (not shown) for securing the housing to the previously mentioned bulkhead. The housing also includes an extension 34 paralleling the cylindrical portion 18 and projecting beyond the free end thereof. This extension may be integral with the cylindrical portion 18 for strength purposes. The extension 34 includes a pair of arms 36, 38 connected at least along a portion of their length by a web 40. A pivot pin 42 extends between the free ends of the arms 36, 38 and has a cover 44 and a spring 46 mounted thereon. The spring acts on the cover 44 and the web 40 to bias the cover to a closed position against the free end of the cylindrical portion 18. The cover 44 further includes first latching lug 48 and second latching lug 50 extending from a surface thereof and positioned to engage with the plug member 14 in the manner to be described later. The latching lugs are also positioned to be received within the cylindrical portion 18 when the cover 44 is closed. The cover can further be provided with sealing means (not shown) if sealing of the cylindrical portion of the receptacle member is desired.

The plug member 14 is quite similar to the standard plug member 12 described in U.S. Pat. No. 4,109,989, the disclosure of which is incorporated herein by reference. The plug member 14 will be described primarily to indicate the differences between it and the standard plug member of the noted patent. The plug member 14 includes a plug housing 52 having a first plurality of first contact bores 54 opening onto a mating face 56 and a second plurality of second bores 58 likewise opening onto the mating face 56. The first and second bores are aligned to receive the primary and secondary terminal pins 22, 24 of the receptacle member. The plug member 14 also includes a longitudinally extending keying projection 60 positioned to be received in the keyway 26 of the receptacle member and a plurality of notches or recesses 62 positioned about the mating face 56 and extending longitudinally of the plug. Each of the notches 62 is aligned to receive therein a respective abutment 28 of the receptacle member. A primary receptacle terminal 64 is received in each respective first bore 54 and a secondary receptacle terminal 66 is received in each respective second bore 58. The plug is further provided with a strain relief assembly 68 which is attached on the rear end of the housing 52 by conventional means, such as screw threads (not shown). The strain relief assembly 68 can be provided with a sealing means 70 in the form of a sleeve that is received around the cable 72 and which is held securely against the cable by the clamping portion 74 of the strain relief 68.

Figure 4:
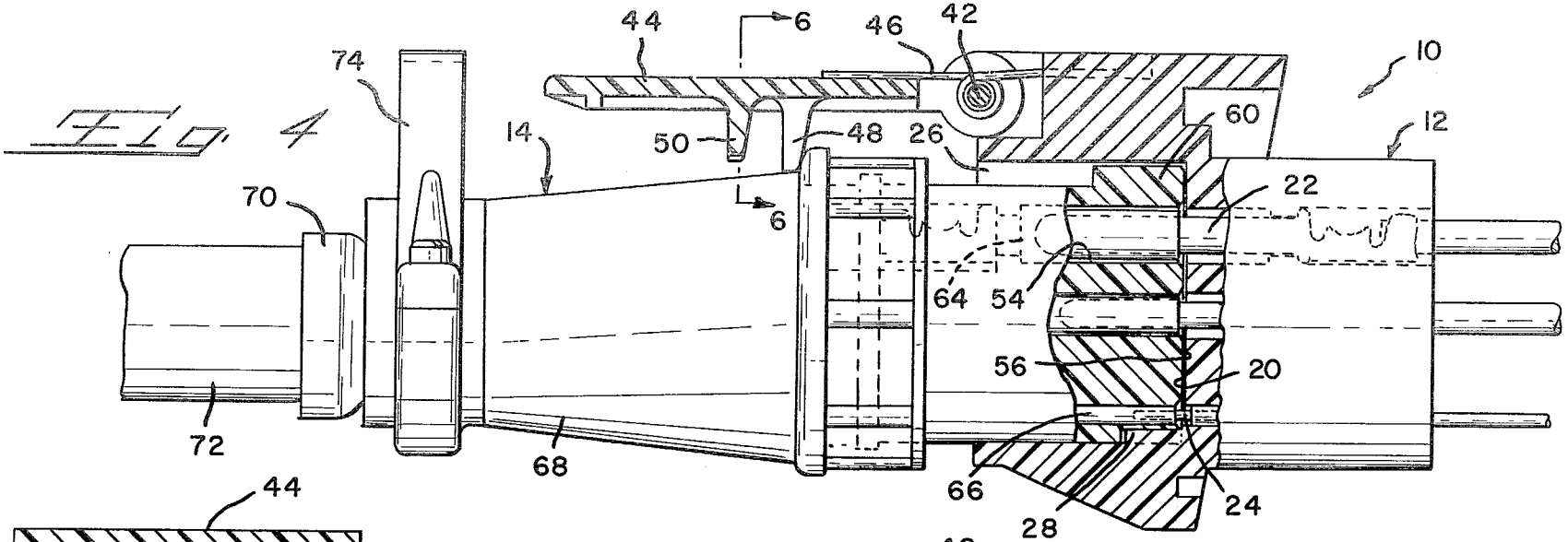
FIG. 4 is a side elevation, partially in section, showing the subject connector in a fully mated condition.
Figure 5:
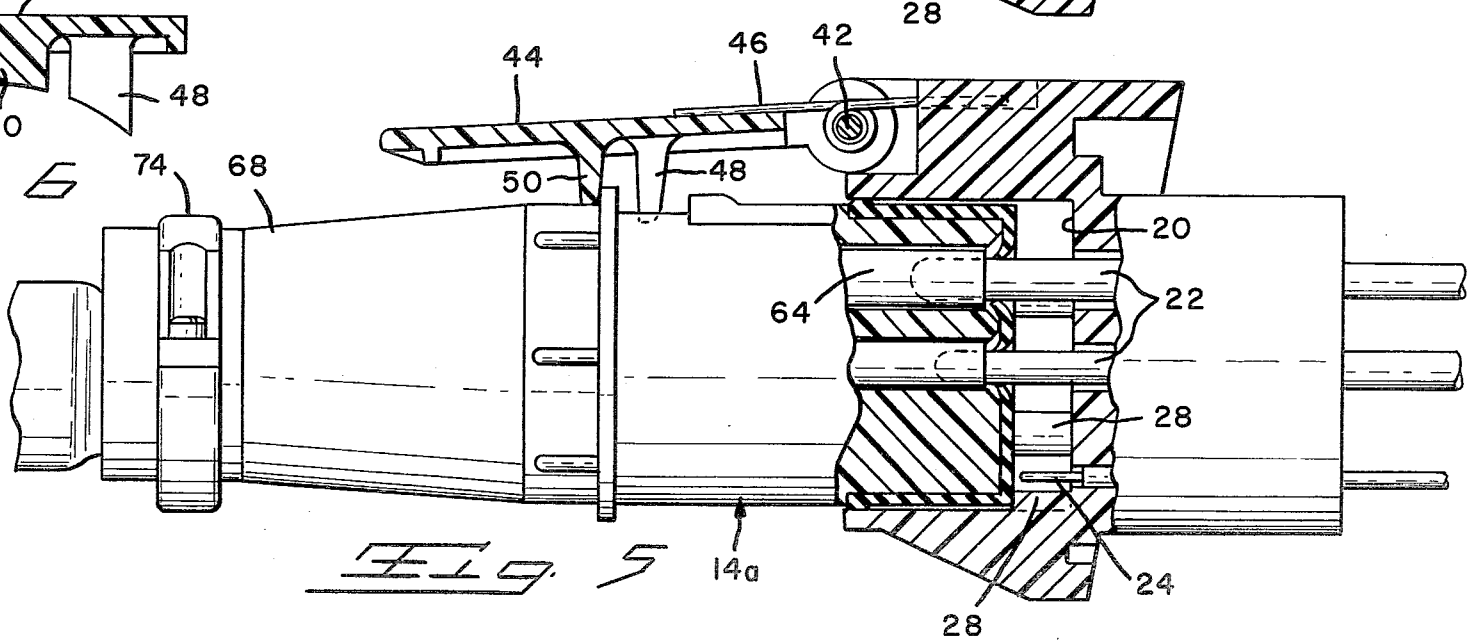
FIG. 5 is a side elevation, partly in section, showing a standard plug partially mated with the receptacle member of the present invention.
Figure 6:
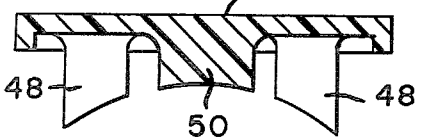
FIG. 6 is a transverse section through the cover of the receptacle member taken along line 6—6 of FIG. 4.

It will be clear from a review of FIGS. 1 and 4 that the receptacle member 12 of the present invention will receive a plug member 14 according to the present invention in a fully mated condition with the first latching lug 48 holding the plug 14 in the fully mated condition. However, it will be seen from FIG. 5 that if a conventional plug **14*a*, such as the one described in the above mentioned U.S. patent, is mated with the subject receptacle member 12 that the abutments 28 will prevent the plug 14*a* from being fully mated. Since the standard plug 14*a* of the prior art is not provided with receptacle terminals of two different sizes in two different arrays, it is necessary to have only the partial mating to prevent unwanted damage to the secondary pin terminals 24 of the subject receptacle. The abutments 28 prevent the standard plug 14*a* from being inserted to such a depth as will cause damage to the secondary pin terminals 24. However, it will be noted from FIG. 5 that though the standard plug 14*a* is not fully seated within the receptacle member, it is sufficiently mated for the primary pin terminals 22 to mate with the pin receptacle terminals 64 and for the second latching lug 50 to engage the standard plug 14*a*** so as to hold the standard plug in a mated condition.

It should be understood that the subject plug member 14 can fully mate with a standard receptacle (not shown) with no problems. The standard receptacle will not have secondary terminal pins and thus the secondary receptacle terminals of the subject plug will be unused.

From the foregoing it should be clear that the subject receptacle can receive either the subject plug or a standard plug and that the subject plug can mate with either the subject or a standard receptacle. Thus any mating combination of subject and standard plugs and receptacles is possible.

The present invention may be subject to many modifications and changes without departing from the spirit or essential characteristics thereof. The present embodiments are therefore to be considered in all respects as illustrative and not restrictive of the scope of the invention.

What is claimed is:

1. A heavy duty electrical connector comprising:

a receptacle member having a housing with a cylindrical hood defining a plug receiving recess terminating in a receptacle mating face, a first plurality of primary terminal pins mounted in a first array in said receptacle mating face and extending into said hood a first distance, a second plurality of secondary terminal pins mounted in a second array in said receptacle mating face and extending into said hood a second distance less than that of said first distance, a plurality of abutments spaced about and extending into said plug receiving recess adjacent said receptacle mating face, each said abutment having a height greater than said second distance and less than said first distance, and cover means mounted on and adapted to close the free end of said cylindrical hood; and a plug member having a housing adapted to be received in said plug receiving recess of said receptacle member, said plug member having a plug mating face, a plurality of first bores in a first array opening into said plug mating face and a plurality of second bores in a second array opening into said plug mating face, said first and second arrays of said bores being aligned with respective terminal pins of said first and second arrays of said receptacle member, a like plurality of primary receptacle terminals each received in a respective first bore and adapted to mate with a respective primary terminal pin, a plurality of secondary receptacle terminals each received in a respective second bore and adapted to mate with a respective secondary terminal pin, and a plurality of notches in the periphery of said plug mating face extending longitudinally of said plug housing a distance greater than the length of said abutments, whereby said plug member is able to fully mate within the plug receiving recess of said receptacle member with said primary and said secondary pin terminals of said receptacle member in engagement with respective primary and secondary receptacle terminals of said plug member, and a standard plug having only primary recetacle terminals is able to only partially mate with said receptacle member to a sufficient depth to make electrical and mechanical interconnection between the primary terminal pins of said receptacle member and primary receptacle terminals of said standard plug without damaging the secondary terminal pins of said receptacle member, and said plug member is able to fully mate with a standard receptacle having only primary terminal pins.

2. An electrical connector according to claim 1 further comprising:

a keyway formed in said receptacle member and a keying projection formed in said plug member whereby mating of said plug member into said receptacle member is polarized.

3. An electrical connector according to claim 1 further comprising:

a cover on said receptacle member adapted to close the free end of said plug receiving cylindrical hood, first and second latching lugs projecting from said cover and adapted to latchingly secure said plug member and a standard plug respectively in said receptacle member.

4. A receptacle member for a heavy duty electrical connector capable of fully receiving a mating plug member and at least partially receiving a standard plug member, said receptacle member comprising:

a housing having a hood portion defining a plug receiving recess therein, said hood portion surrounding and enclosing a mating face;

a first plurality of primary terminal pins mounted in said mating face in a first array and extending a first distance therefrom;

a second plurality of secondary terminal pins mounted in said mating face in a second array and extending therefrom a second distance less than said first distance;

a plurality of abutments extending inwardly of said hood portion adjacent said mating face, said abutments having a length intermediate said first and second distances whereby a mating plug member having both primary and secondary receptacle terminals can be fully mated in said receptacle member while a standard plug having only primary receptacle terminals may be mated only sufficiently to engage the primary terminal pins with said abutments preventing full mating and damage to said secondary terminal pins.

5. A receptacle member according to claim 4 further comprising a cover mounted on the free end of and biased to close said hood portion, said cover having first and second latching means for securing mating plug members and standard plug members respectively in a full and a partially mated condition therewith.

* * * * *